US010215409B2

(12) United States Patent
Lefebvre et al.

(10) Patent No.: US 10,215,409 B2
(45) Date of Patent: Feb. 26, 2019

(54) VALVE ASSEMBLY FOR A GAS LIGHTER

(71) Applicant: SOCIETE BIC, Clichy (FR)

(72) Inventors: Guy Lefebvre, Redon (FR); Yann Lefebvre, Pornichet (FR)

(73) Assignee: SOCIÉTÉ BIC, Clichy (FR)

( * ) Notice: Subject to any disclaimer, the term of this patent is extended or adjusted under 35 U.S.C. 154(b) by 713 days.

(21) Appl. No.: 14/435,243

(22) PCT Filed: Oct. 12, 2012

(86) PCT No.: PCT/IB2012/002306
§ 371 (c)(1),
(2) Date: Apr. 13, 2015

(87) PCT Pub. No.: WO2014/057300
PCT Pub. Date: Apr. 17, 2014

(65) Prior Publication Data
US 2015/0292738 A1 Oct. 15, 2015

(51) Int. Cl.
*F23Q 2/34* (2006.01)
*F23Q 2/173* (2006.01)

(52) U.S. Cl.
CPC ..... *F23Q 2/34* (2013.01); *F23Q 2/173* (2013.01)

(58) Field of Classification Search
CPC . F23Q 2/173; F23Q 2/32; F23Q 2/162; F23Q 2/163
See application file for complete search history.

(56) References Cited

U.S. PATENT DOCUMENTS 3,014,357 A * 12/1961 Zellweger ..... F23Q 2/173 222/3
3,083,554 A * 4/1963 Iketani ..... F23Q 2/173 222/3
3,208,243 A * 9/1965 Zellweger ..... F23Q 2/163 431/131
3,218,831 A * 11/1965 Newman ..... F23Q 2/173 222/3

(Continued)

FOREIGN PATENT DOCUMENTS

EP 1 533 570 A1 5/2005
JP 7-55140 3/1955

(Continued)

OTHER PUBLICATIONS

International Report of PCT/IB2012/002306; dated Jul. 12, 2013.

*Primary Examiner* — Kenneth Rinehart
*Assistant Examiner* — Deepak Deean
(74) *Attorney, Agent, or Firm* — Polsinelli PC

(57) ABSTRACT

A gas lighter valve assembly that can be fitted easily and tightly into a gas lighter body or a well as a free-floating entity not fixed to the gas lighter body or well. The valve assemblies integration as a free floating entity within the lighter body or well avoids the necessity of an interference fit. To avoid the necessity of an interference fit, valve assembly positioning and stability is achieved by the use of an o-ring which is compressed by downward force exerted by a pressing cover upon a bushing or directly upon the o-ring. By eliminating the stress and friction typically caused by an interference fit, the lighter body and reservoir can be made from a variety of materials including non-crystalline resins.

12 Claims, 2 Drawing Sheets

(56) References Cited

U.S. PATENT DOCUMENTS

| | | | | | |
|---|---|---|---|---|---|
| 3,320,775 | A * | 5/1967 | Wright | F23Q 2/173 | 222/3 |
| 3,399,951 | A * | 9/1968 | Masaru | F23Q 2/173 | 431/344 |
| 3,499,719 | A * | 3/1970 | Kitabayashi | F23Q 2/173 | 431/344 |
| 3,533,721 | A * | 10/1970 | Hocq | F23Q 2/173 | 138/43 |
| 4,690,377 | A * | 9/1987 | Nitta | F16K 1/303 | 141/18 |
| 4,929,176 | A * | 5/1990 | Nitta | F23Q 2/163 | 137/550 |
| 2004/0152029 | A1* | 8/2004 | Doucet | F23Q 2/162 | 431/344 |
| 2005/0175947 | A1* | 8/2005 | Ichikawa | F23Q 2/173 | 431/344 |

FOREIGN PATENT DOCUMENTS

| | | | |
|---|---|---|---|
| WO | WO 2004/003433 | A1 | 1/2004 |
| WO | WO 2007/140048 | A2 | 12/2007 |
| WO | WO 2012/076925 | A1 | 6/2012 |

* cited by examiner

VALVE ASSEMBLY FOR A GAS LIGHTER

This application is a national stage application of International Application No. PCT/IB2012/002306, filed on Oct. 12, 2012, the entire contents of which are incorporated herein by reference.

FIELD OF INVENTION

The embodiments of the present invention relate to a valve assembly for gas lighters and methods for assembly and integration of the valve assembly with and into a gas lighter body or well formed therein.

BACKGROUND OF THE INVENTION

Generally, the embodiments of the present invention relate to a method by which a valve assembly is tightly and easily integrated into a gas lighter body made from a non-crystalline resin such as styrene acrylonitrile (AS/SAN) resin, ABS, polycarbonate (PC) and the like. Specifically, the embodiments of the present invention relate to a method of integrating a valve assembly into a lighter body or well therein as a free floating entity not fixed to the lighter body, a well therein, or another component which is itself fixed to the lighter body or a well therein.

Inexpensive gas lighters are typically made of amorphous polymers which have the advantage of transparency such that users are able to see the level of fuel remaining within the lighter's reservoir. Despite this advantage, typically used polymers such as AS/SAN, ABS, and polycarbonate may be brittle as a result of their non-crystalline structure. Additionally, to prevent gas leaks, valve assemblies must be integrated into lighter bodies tightly and with precision. This is often accomplished by press or interference fitting the valve assembly within the lighter body. The stress of this interference fit is often too much for the non-crystalline resin and results in cracking of the lighter body and the necessary disposal of the lighter body.

To avoid this costly issue, several methods have emerged to facilitate integration of valve assemblies without compromising the integrity of the lighter body. One such method, as disclosed in WO 01/18452 A1 and U.S. Pat. No. 4,101,262, employs the use of screw threads and an o-ring such that the valve assembly is screwed upon its thread into the lighter body or a well therein. However, the use of screw threads elongates the manufacturing process as complex moulds are necessary to form the component's threads. Similarly, the introduction of threads complicates the assembly process as it is often difficult to automate the act of screwing the component into the lighter body or well therein. While possibly minimizing the chance of cracking upon the valve assembly's insertion, the use of screw threads is costly in terms of manufacture and assembly.

Additional alternatives include the introduction of a snap-fitting mechanism in which the bottom most part of a valve assembly is formed with a "bulging pawl" that is larger than the well in which the assembly is fit such as disclosed in Japanese patent application JP 7-055140. Upon insertion, the wider "bulging pawl" is compressed such that it snaps into place under the lip of the well at the top of the lighter reservoir. This snapping, in turn, holds the valve assembly in place but does not eliminate the possibility of cracking as the assembly must be inserted with sufficient force to snap the wider section of the assembly (the "bulging pawl") into place.

Finally, attempts have been made to avoid cracking of a lighter body's resin by the use of an o-ring, press fitting, and annular projections that are ultrasonically welded to the lighter body or a well therein as disclosed in patent WO 2007/140048 A2. That is, the valve assembly itself is formed with projections on its periphery that are melted into the lighter body or a well therein ultrasonically. The disadvantage of this method, however, is the risk of damaging the lighter's permeable membrane by the vibrations produced during ultrasonic welding. Such damage to the permeable membrane may affect the quantity of fuel supplied by the valve assembly and, subsequently, may result in dangerous flame height and fuel leakage during use.

SUMMARY OF THE EMBODIMENTS OF THE PRESENT INVENTION

The embodiments of the present invention aim to eliminate the above mentioned complications and disadvantages by a simplified integration of a lighter's valve assembly within the lighter body or a well therein while also providing for a gas tight seal. In this respect, the valve assembly and method of integration of the embodiments of the present invention will permit the continued use of non-crystalline resins without compromising the integrity of the lighter or increasing the cost of production or assembly.

To this end, a gas lighter and valve assembly is proposed with the valve assembly being inserted into a well in the lighter body as a free-floating entity without interference fit with the lighter or well therein. The valve assembly is characterized by an o-ring positioned on its lower periphery that is compressed by a pressing cover fixed to the top of the lighter body or well therein by means of gluing or ultrasonic weld. Downward force exerted by the pressing cover compresses the o-ring against the lighter body or floor of a well therein such that the valve assembly is held in place. In this respect, the valve assembly is held in between the compressed o-ring and pressing cover and is not directly fixed to the lighter body, a well therein, or any component fixed to the lighter body or well therein.

The valve assembly's peripheral o-ring may be positioned at the assembly's lower end such that it is compressed indirectly by the pressing cover between the valve assembly's bushing and the floor of the lighter well, as in embodiment 1. Alternatively, the valve assembly's peripheral o-ring may be positioned at the assembly's upper portion such that the o-ring remains external to the lighter's well in a peripheral recess created in the lighter's body. The o-ring is compressed directly by the pressing cover against the valve assembly on one side and the floor of the peripheral recess on the other. In both positions, however, compression of the assembly's peripheral o-ring is accomplished by means of the pressing cover exerting downward force. Further, regardless of the o-ring's location relative to the pressing cover, the valve assembly is integrated into the lighter body's well without interference with the lighter body, the lighter body's well, or any component directly fixed to the lighter body or well therein.

DETAILED DESCRIPTION OF THE EMBODIMENTS OF THE PRESENT INVENTION

Figure 1:
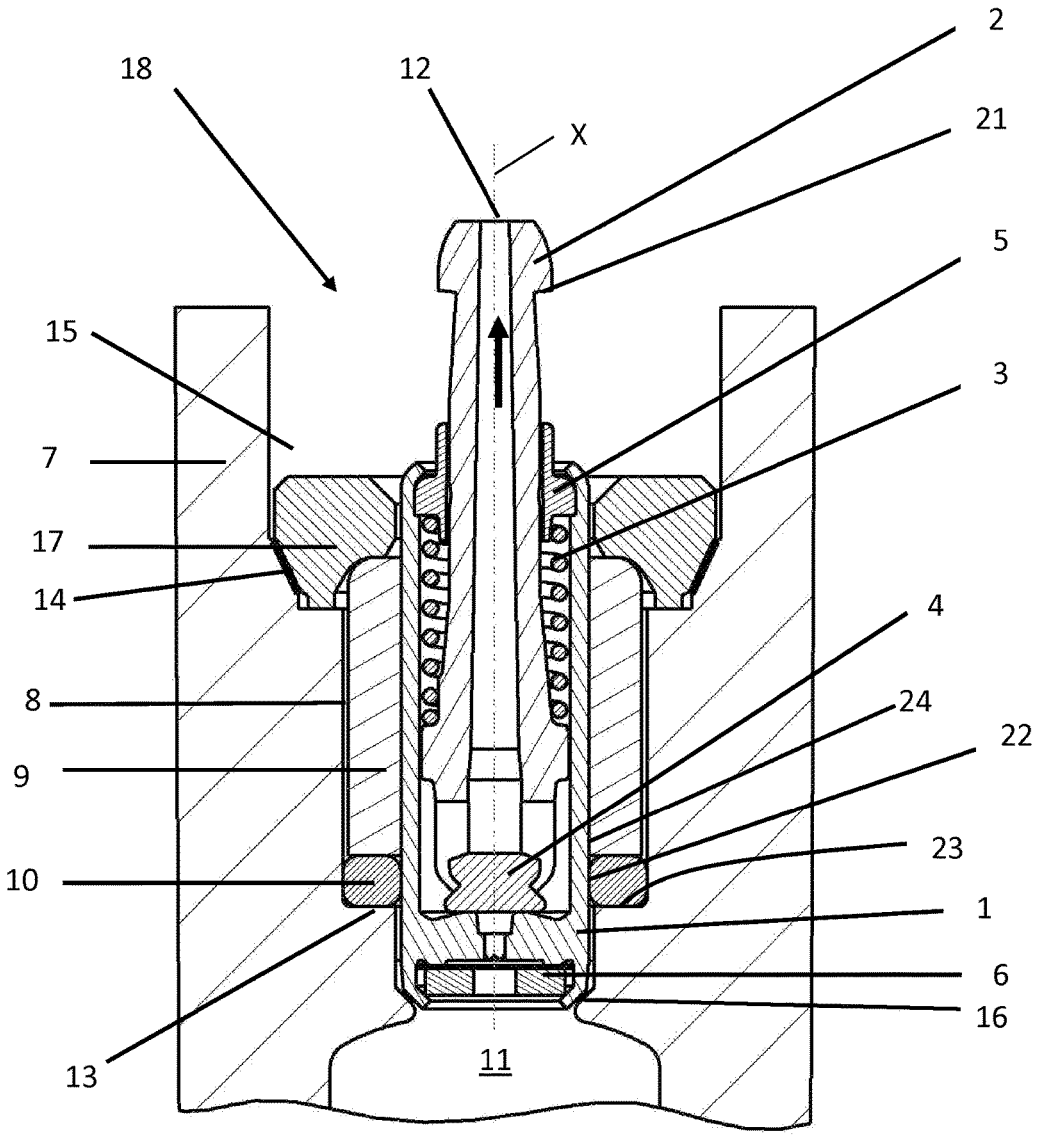
FIG. 1 is a vertical cross sectional view showing the valve regulating assembly mounted within a well of a gas lighter with an o-ring positioned around its lower periphery.

FIG. 1 is a vertical cross sectional view of embodiment 1 showing a unitary valve regulating assembly 18 with a diameter of approximately 3.5 millimeters and a length of approximately 15 millimeters and facilitating, at its bottom portion, gas pressure reduction and evaporation for the liquid fuel contained in the lighter's reservoir. To perform these functions, the bottom portion of the valve regulating assembly 18 contains a permeable membrane 6, maintained by a disk crimped inside the valve body 1. The upper portion of the valve regulating assembly 18 facilitates opening and closing functions for gas flow through the valve regulating assembly's 18 jet 2 and is equipped with an outlet 12 having a shoulder 21, a globe seal 4 maintained under pressure exerted by a jet spring 3 and guided by a washer 5 inside the valve regulating assembly's 18 body 1.

A cylindrical bushing 9 made preferably from crystallized resin such as polyoxymethylene is integrated on the peripheral of the valve regulating assembly 18 by interference fit. An o-ring 10 is mounted below the cylindrical bushing 9 around the periphery of the valve regulating assembly 18.

Comprised of the components above, the valve regulating assembly 18 includes an independent and complete unit that can be freely mounted in a cylindrical well 8 of a lighter body 7. The o-ring 10 positioned below the valve regulating assembly's 18 bushing 9 and above the well's 8 floor, ensures the stability and fit of the unitary valve regulating assembly 18. The position of the valve regulating assembly 18, and the seal to prevent fuel leaks, is ensured by a recess 16 positioned at the bottom most portion of the valve regulating assembly 18 at the bottom of the well 8 and just above the lighter's reservoir 11. Further, compression of the o-ring 10 is maintained by means of a pressing cover 17 fixed to the lighter body 7 atop the well 8 by ultrasonic welding 14 or other means. Additionally, the gas tight seal could be secured by the introduction of liquid glue into the peripheral recess 15 into which the pressing cover 11 is disposed atop the lighter's well 8.

Figure 2:
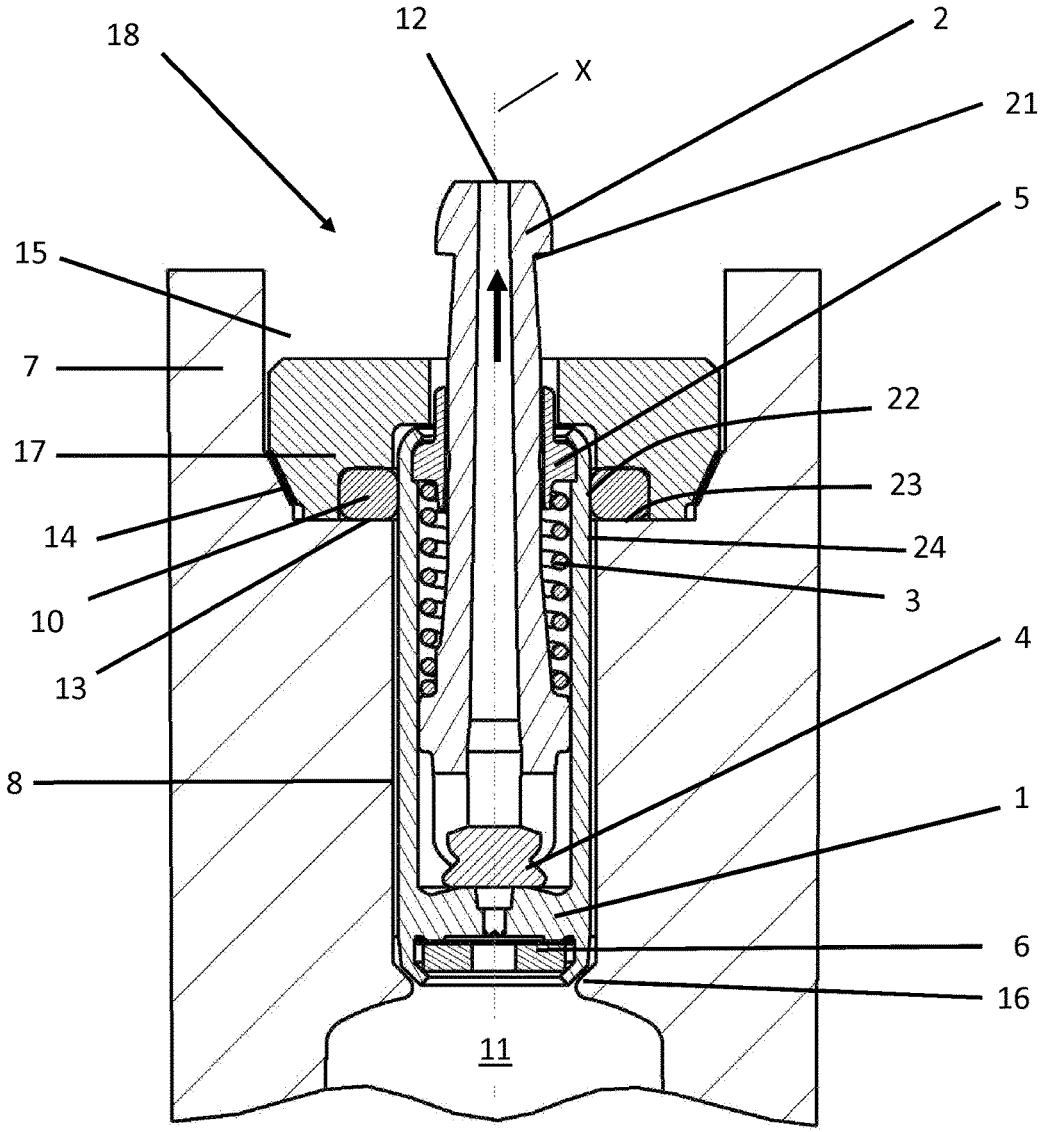
FIG. 2 is a vertical cross sectional view of an alternate embodiment of the valve regulating assembly with its o-ring positioned around its upper periphery and external to the well.

In the second embodiment, shown in FIG. 2, a valve regulating assembly 18 with a diameter of approximately 3.5 millimeters and a length of approximately 15 millimeters is shown facilitating, at its bottom portion, gas pressure reduction and evaporation for the liquid fuel contained in the lighter reservoir 11. As with the embodiment shown in FIG. 1, the bottom portion of the valve regulating assembly 18 contains a permeable membrane 6, maintained by a disk crimped inside the valve body 1. The upper portion of the valve regulating assembly 18 facilitates opening and closing functions for gas flow through the valve regulating assembly's 18 jet 2 and is equipped with an outlet 12, a globe seal 4 maintained under pressure exerted by a jet spring 3 and guided by a washer 5 inside the valve regulating assembly's 18 body 1.

The o-ring 10 depicted in FIG. 2 is positioned around the periphery of the unitary valve regulating assembly 18, but is positioned such that it is not contained within the cylindrical well 8 of the lighter body 7. Rather, the o-ring 10 is positioned such that it is compressed between the pressing cover 17 on its top side and the floor of the peripheral recess 15 on its bottom side. Downward compression of the o-ring 10 results in the lateral stabilization of the valve assembly 18 by the o-ring 10. In this respect, the pressing cover 17 acts directly on the o-ring 10 to maintain the stability of the valve regulating assembly 18 within the well 8 of the lighter body 7. As was the case with embodiment 1, the pressing cover 17 is disposed within the peripheral recess 15 and fixed to the lighter body 7 by ultrasonic weld 14. Similarly, the position of the valve regulating assembly 18, and the seal to prevent fuel leaks, is ensured by a recess 16 positioned at the bottom most portion of the valve regulating assembly 18 at the bottom of the well 8 and just above the lighter's reservoir 11.

In both embodiments disclosed above, the O-ring 10 is pressed downward onto a bearing 13 formed either on the bottom of the well (FIG. 1) or at the top of the well (FIG. 2). The vertical compression along the valve axis X squeezes the annular O-ring which consequently expands radially. As a result, the radially interior portion 22 of the O-ring presses on the cylindrical external surface 24 of the valve assembly 18 thereby providing a first gastight contact surface. Similarly, the inferior portion 23 of the O-ring presses on the bearing 13 so as to provide another annular gastight contact surface. Both gastight contact annular surfaces ensure a gastight seal between the valve regulating assembly 18 and the lighter body 7 to prevent gas leakage.

Further, due to the frusto-conical shape of the gluing/welding area 14, the pressing cover is centered relative to the well axis. As a result of this arrangement, the above mentioned radial forces have an effect of centering the valve assembly 18 in the well axis, so that the valve axis X coincides with the well axis; also the above mentioned radial forces have an effect of laterally stabilizing the valve assembly 18 into the well.

It shall be appreciated that the disclosed valve assembly on lighter does not require a force fit insertion into the well since a clearance is arranged in both embodiments, i.e. between the outer surface of bushing 9 and inner wall of well 8 in the first embodiment, and between the outer surface 24 of valve assembly 18 and inner wall of well 8 in the second embodiment. Further, the assembly arrangement of valve assembly 18 on lighter is deprived of any thread. It should also be noted that, in the depicted examples, the bearing 13 extends substantially perpendicular to the valve axis X, although it could also be otherwise or inclined.

The advantages of the unitary valve regulating assembly 18 are many and include the ability to fully inspect all components of the valve regulating assembly 18 as an independent unit and prior to installation for compliance with functional requirements such as evaporation, flow regulation, flow stability, opening/closing, and sufficient sealing. Further, the use of an o-ring 10 and a pressing cover 17 ensures that the valve regulating assembly 18 is integrated into the well 8 of the lighter body 7 without being directly fixed to the well 8 or the lighter body 7 or any component that is fixed to the lighter body 7 or well 8 therein. This free-floating assembly and integration of the valve regulating assembly 18 prevents even the possibility of interference with and, consequently, the introduction of stress into, the lighter body 7 or well therein 8 and the introduction of cracks or fractures.

The embodiments of the present invention have been described according to the preferred embodiments depicted in FIG. 1 and FIG. 2, respectively. These embodiments, however, provide an example of the invention and, as such, the invention is not restricted thereto. Rather, it will be understood by those familiar with and skilled in the art that modification and variation may be made within the scope of the present invention as defined and limited only by the following claims.

The invention claimed is:

1. A valve assembly system for a gas lighter comprising:

a gas lighter body formed with a well open at a top end and providing a passage to a fuel reservoir at a bottom end;

a valve regulating assembly disposed in the well of the gas lighter body, the valve regulating assembly comprising a valve body including a filter, a jet with a globe seal and a spring, the jet being guided by a washer and having a nozzle for flow of fuel; the filter, the jet with the globe seal, the spring and the washer all being disposed internally of and enclosed within the valve body;

an o-ring positioned around the periphery of a portion of the valve body and above a bearing arranged at the well; and a pressing cover disposed in a peripheral recess atop the well and arranged above the bearing, adapted to press directly or indirectly the o-ring downward, wherein by a vertical compression of the o-ring due to a downward force exerted from the pressing cover on the o-ring toward the bearing of the well, wherein the valve regulating assembly is free-floating within the well such that compression of the o-ring provides an effect of stabilizing the valve regulating assembly within the well and creates a seal between the valve regulating assembly and the lighter body, and wherein the pressing cover is permanently fixed to the lighter body by gluing or ultrasonic welding.

2. The valve assembly system according to claim 1, further comprising:

a bushing positioned on the periphery of the valve body, and interposed between the pressing cover and the o-ring, wherein the bearing is arranged on a bottom floor of the well; and wherein the pressing cover is disposed so as to cover the exposed portion of the bushing.

3. The valve assembly system according to claim 1, wherein the lighter body and the well are made of a non-crystalline resin comprising styrene acrylonitrile, ABS, or polycarbonate.

4. The valve assembly system according to claim 1, wherein the valve body is made of metal and is mounted with radial clearance and without an interference fit with the well formed within the lighter body.

5. The valve assembly according to claim 2, wherein the bushing is made of crystallized resin comprising polyoxymethylene.

6. The valve assembly according to claim 2, wherein the bushing is mounted on the periphery of the valve body by an interference fit.

7. The valve assembly according to claim 2, wherein the bushing extends above the top of the well.

8. The valve assembly according to claim 2, wherein a recess is positioned on the bottom portion of the valve assembly.

9. The valve assembly system according to claim 1, wherein the bearing is arranged atop the well;

wherein the o-ring is arranged above the well into the peripheral recess and the ring is interposed directly between the pressing cover and the bearing, wherein the compression of the o-ring has the effect of laterally stabilizing the valve regulating assembly within the well.

10. The valve assembly according to claim 1, wherein the assembly of the valve assembly in the lighter body or well is deprived of thread.

11. The valve assembly according to claim 1, wherein the bearing extends substantially perpendicular to the valve axis.

12. The valve assembly according to claim 1, wherein the compression of the o-ring has an effect of centering the valve assembly within the well.

* * * * *